US009000683B2

(12) United States Patent
Del Carmen, Jr. et al.

(10) Patent No.: US 9,000,683 B2
(45) Date of Patent: Apr. 7, 2015

(54) BLEEDER CIRCUIT HAVING CURRENT SENSE WITH EDGE DETECTION

(71) Applicant: Power Integrations, Inc., San Jose, CA (US)

(72) Inventors: Jose Requinton Del Carmen, Jr., San Jose, CA (US); Christian Pura Angeles, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 62 days.

(21) Appl. No.: 13/777,924

(22) Filed: Feb. 26, 2013

(65) Prior Publication Data

US 2014/0239849 A1 Aug. 28, 2014

(51) Int. Cl.
*H05B 37/02* (2006.01)
*H05B 33/08* (2006.01)

(52) U.S. Cl.
CPC ..... *H05B 37/02* (2013.01); *H05B 33/0815* (2013.01); *H05B 33/0851* (2013.01)

(58) Field of Classification Search
USPC ..... 315/185 R, 200 R, 291, 294, 297, 307
See application file for complete search history.

(56) References Cited

U.S. PATENT DOCUMENTS

| | | | | |
|---|---|---|---|---|
| 7,978,485 | B2 | 7/2011 | Stamm et al. | |
| 8,115,457 | B2 | 2/2012 | Balakrishnan et al. | |
| 8,264,165 | B2 | 9/2012 | Gu et al. | |
| 8,581,498 | B1 | 11/2013 | Cheung et al. | |
| 8,643,297 | B2 | 2/2014 | Yang et al. | |
| 8,692,479 | B2 * | 4/2014 | Mercier et al. | 315/291 |
| 2007/0024213 | A1 * | 2/2007 | Shteynberg et al. | 315/291 |
| 2007/0171698 | A1 | 7/2007 | Hoenigschmid et al. | |
| 2007/0285028 | A1 * | 12/2007 | Tsinker et al. | 315/224 |
| 2008/0224629 | A1 * | 9/2008 | Melanson | 315/247 |
| 2010/0207536 | A1 | 8/2010 | Burdalski et al. | |
| 2010/0301955 | A1 | 12/2010 | Luong et al. | |
| 2012/0056553 | A1 * | 3/2012 | Koolen et al. | 315/291 |

(Continued)

FOREIGN PATENT DOCUMENTS

| | | | |
|---|---|---|---|
| CN | 102148564 | A | 8/2011 |
| WO | WO 2011/045057 | A1 | 4/2011 |

OTHER PUBLICATIONS

"AN2711—Application Note: 15 W Offline TRIAC Dimmable LED Driver," STMicroelectronics, Doc. ID 14425, Rev. 2, Apr. 2009 (33 pages).

(Continued)

*Primary Examiner* — Tung X Le
(74) *Attorney, Agent, or Firm* — Blakely Sokoloff Taylor & Zafman LLP

(57) ABSTRACT

A bleeder circuit for use in a power converter of a lighting system includes a current sense circuit coupled between first and second terminals of an input of a driver circuit to be coupled to drive a load. The current sense circuit is coupled to output a current sense signal in response to an input current through an input of the power converter coupled to the input of the driver circuit. An edge detection circuit is coupled between the first and second terminals to output an edge detection signal in response to an input signal between the first and second terminals. A variable current circuit is coupled between the first and second terminals to conduct a bleeder current between the first and second terminals in response to current sense signal and further in response to the edge detection signal.

33 Claims, 5 Drawing Sheets

(56) References Cited

U.S. PATENT DOCUMENTS

| | | | | |
|---|---|---|---|---|
| 2012/0126714 | A1* | 5/2012 | Deppe et al. | 315/192 |
| 2012/0286663 | A1* | 11/2012 | Puvanakijjakorn et al. | 315/85 |
| 2013/0169177 | A1* | 7/2013 | Liao et al. | 315/200 R |
| 2013/0278159 | A1* | 10/2013 | Del Carmen et al. | 315/200 R |
| 2014/0042922 | A1* | 2/2014 | Wu et al. | 315/201 |

OTHER PUBLICATIONS

"AN-9745: Design Guide for TRIAC Dimmable LED Driver Using FL7730," Fairchild Semiconductor, Rev. 1.0.1, Oct. 31, 2011 (11 pages).

Del Carmen Jr. et al., U.S. Appl. No. 13/449,922, filed Apr. 18, 2012.

Hall, J. K. et al., "Frequency Spectrum Generated by Thyristor Control," Electrocomponent Science and Technology, 1974, vol. 1, pp. 43-49.

U.S. Appl. No. 13/449,922—Non-Final Office Action, mailed Mar. 25, 2014, 13 pages.

CN Patent Application No. 201310136140.7—Chinese Office Action, with English Translation, and Search Report, issued Oct. 30, 2014 (11 pages).

* cited by examiner

BLEEDER CIRCUIT HAVING CURRENT SENSE WITH EDGE DETECTION

BACKGROUND INFORMATION

1. Field of the Disclosure

The present invention relates generally to power supplies. More specifically, examples of the present invention are related to lighting systems including dimming circuitry for use with power supplies.

2. Background

Electronic devices use power to operate. Power is generally delivered through a wall socket as high voltage alternating current (ac). A device typically referred to as a power converter or as a power converter can be utilized in lighting systems to convert the high voltage ac input into a well regulated direct current (dc) output through an energy transfer element. Switched mode power converters are commonly used due to their high efficiency, small size, and low weight to power many of today's electronics. During operation, a switch included in a driver circuit of the power converter is utilized to provide the desired output by varying the duty cycle (typically the ratio of the on time of the switch to the total switching period), varying the switching frequency or varying the number of pulses per unit time of the switch in a power converter.

In one type of dimming for lighting applications, a TRIAC dimmer circuit, or a thyristor dimmer circuit, removes a portion of the ac input voltage to limit the amount of voltage and current supplied to an incandescent lamp. This is known as phase dimming because it is often convenient to designate the position of the missing voltage in terms of a fraction of the period of the ac input voltage measured in degrees. In general, the ac input voltage is a sinusoidal waveform and the period of the ac input voltage is referred to as a full line cycle. As such, half the period of the ac input voltage is referred to as a half line cycle. An entire period has 360 degrees, and a half line cycle has 180 degrees. Typically, the phase angle is a measure of how many degrees (from a reference of zero degrees) of each half line cycle the dimmer circuit removes. As such, removal of half the ac input voltage in a half line cycle by a TRIAC dimmer circuit corresponds to a phase angle of 90 degrees. In another example, removal of a quarter of the ac input voltage in a half line cycle may correspond to a phase angle of 45 degrees.

Although phase angle dimming works well with incandescent lamps that receive the altered ac line voltage directly, phase angle dimming typically creates problems for light emitting diode (LED) lamps driven by a switched mode power converter. Conventional regulated switched mode power converters are typically designed to ignore distortions of the ac input voltage and deliver a constant regulated output until a low input voltage causes them to shut off. As such, conventional regulated switched mode power converters cannot dim LED lamps. Unless a power converter for an LED lamp is specially designed to recognize and respond to the voltage from a TRIAC dimmer circuit in a desirable way, the dimmer circuit can produce unacceptable results such as flickering of the LED lamp.

Another difficulty in using TRIAC dimmer circuits with LED lamps comes from a characteristic of the dimmer circuit itself. For instance, a TRIAC dimmer circuit is a semiconductor component that behaves as a controlled ac switch. In other words, it behaves as an open switch to an ac voltage until it receives a trigger signal at a control terminal, which causes the switch to close. The switch remains closed as long as the current through the switch is above a value referred to as the holding current. Most incandescent lamps use more than enough current from the ac power source to allow reliable and consistent operation of a TRIAC dimmer circuit. However, the low current used by efficient power converters to drive LED lamps may not draw sufficient current to keep the dimmer circuit conducting for the expected portion of the ac line period.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
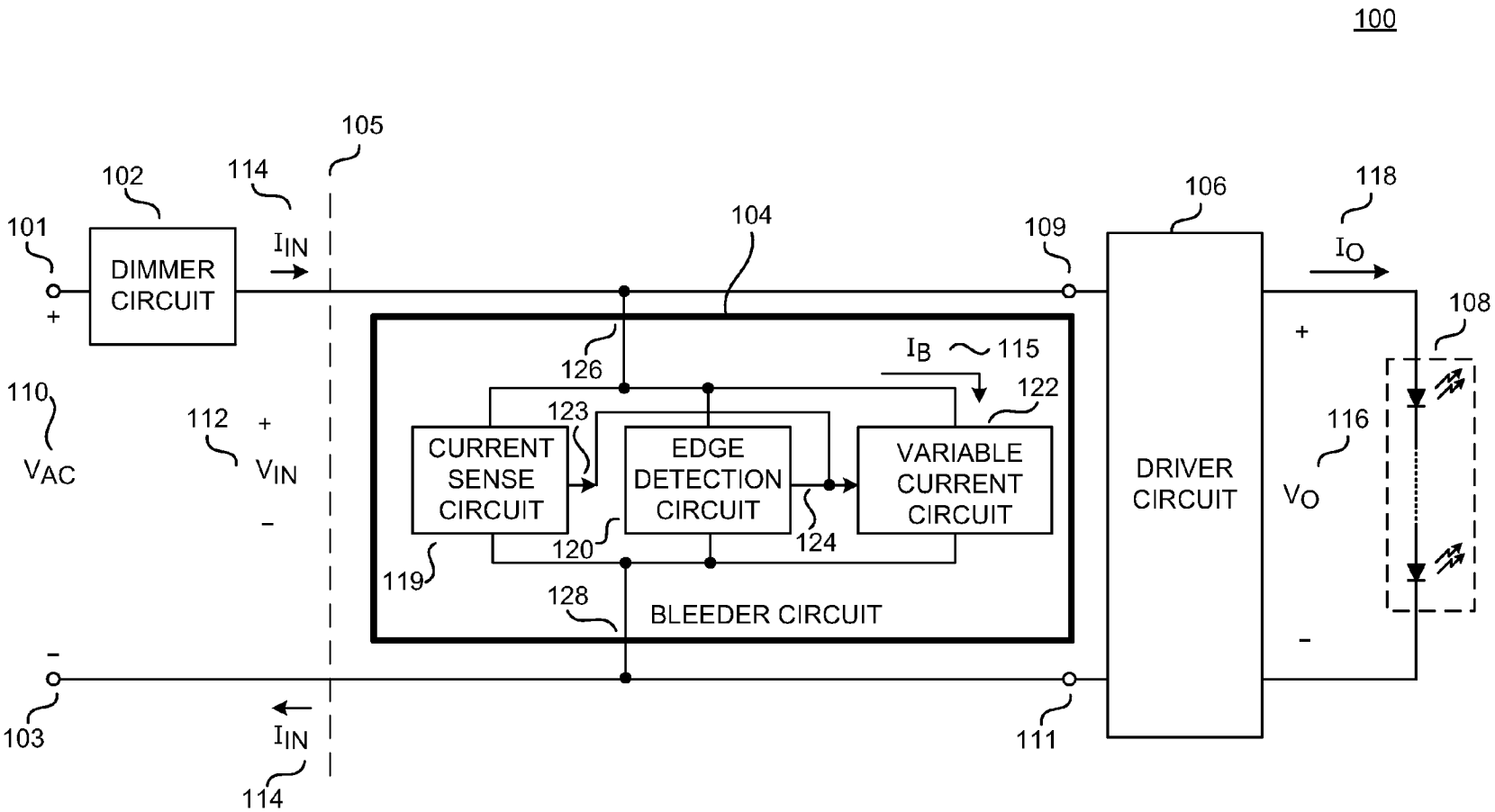
FIG. 1 is a functional block diagram of one example of a power converter included in a lighting system including an example bleeder circuit in accordance with the teachings of the present invention.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention.

Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

As mentioned above, a TRIAC dimmer circuit is one example of a dimming circuit included in power supplies utilized in lighting applications that removes a portion of the ac input voltage to limit the amount of voltage and current supplied to an incandescent lamp. However, if an LED lamp is driven by a power converter that is utilized with a TRIAC dimmer circuit, unless the power converter is specially designed to recognize and respond in a desirable way to a voltage having removed portions, the TRIAC dimmer circuit can produce unacceptable results such as flickering of the LED lamp. In addition, since LED lamps generally draw less current than incandescent lamps, the low current drawn by efficient power converters that drive LED lamps from the ac power source may not be enough current (i.e., the holding current) to keep a TRIAC dimmer circuit conducting for the expected portion of the ac line period. Furthermore, the high frequency transition of the sharply increasing input voltage that occurs when the dimmer circuit fires during each half line cycle causes inrush input current ringing, which may reverse several times during the half line cycle. During these current reversals, the dimmer circuit may prematurely turn off and cause flickering in the LED lamp.

Therefore, power converter controller designs usually rely on including a dummy load with the power converter to take enough extra current from the input of the power converter to keep the TRIAC dimmer circuit conducting. In addition, a bleeder circuit may be utilized to keep the current through the TRIAC dimmer circuit above the holding current. Conventional bleeder circuits may include a series damping resistance, which is coupled between the TRIAC dimmer circuit and the input of the power converter. However, the series damping resistance conducts current (and therefore dissipates power) while a voltage is present. As such, use of a series damping resistance affects the efficiency of the overall power conversion system.

Accordingly, examples of power supplies used in lighting systems with dimming circuitry include bleeder circuits that utilize various examples of current sense circuits, edge detection circuits and variable current circuits in accordance with the teachings of the present invention. As will be shown, an example current sense circuit included in an example bleeder circuit senses an input current of the power converter to determine if the input current has fallen below a threshold current and outputs a current sense signal to the variable current circuit. An example edge detection circuit includes a high pass filter that senses high frequency transitions in an input signal of the driver circuit to determine when there is an edge in the input signal of the power converter. A high frequency transition indicates when the dimmer circuit has fired. The edge detection circuit provides an edge detection signal to the variable current circuit. In one example, once the edge detection signal indicates that dimmer circuit has fired by sensing the high frequency transition, the variable current circuit conducts a bleeder current, which provides enough current to keep the dimmer circuit conducting. In addition, in one example, if the current sense signal indicates that the input current has fallen to less than the threshold current, the variable current circuit conducts the bleeder current. In the examples, the variable current circuit continues conducting the bleeder current until the input current is greater than the threshold current or until the end of the half line cycle or until the output of the dimmer circuit has fallen to zero. In the examples, the bleeder circuit does not conduct any bleeder current if the input current is greater than the holding current of the dimmer circuit or until an edge has been sensed in the input signal. As such, during normal operation of the power converter of the lighting system, there is no loss in efficiency due to the bleeder circuit in accordance with the teachings of the present invention.

To illustrate, FIG. 1 is a functional block diagram of a lighting system including one example of a power converter 100 having an example bleeder circuit 104 in accordance with the teachings of the present invention. As shown in the depicted example, power converter 100 includes a driver circuit 106 that is coupled to drive a load 108 with an output voltage $V_O$ 116 and an output current $I_O$ 118. In one example, driver circuit 106 includes a switched mode power converter and load 108 includes one or more light emitting diode (LED) lamps. Power converter 100 includes a driver circuit 106 with an input having a first terminal 109 and a second terminal 111 that are coupled to an input 105 of the power converter 100, which is coupled to receive an input signal $V_{IN}$ 112 and an input current $I_{IN}$ 114. In one example, input signal $V_{IN}$ 112 is to be received from a dimmer circuit 102, which is coupled to receive an ac line voltage $V_{AC}$ 110 between terminals 101 and 103. Dimmer circuit 102 may be external to power converter 100. In one example, dimmer circuit 102 is a TRIAC dimmer circuit, which adds high frequency transitions to input signal $V_{IN}$ 112 by removing portions of the ac line voltage $V_{AC}$ 110 to limit the amount of voltage and current supplied by input signal $V_{IN}$ 112 and input current $I_{IN}$ 114, respectively, that are received by the power converter 100. In another example, dimmer circuit 102 may include a thyristor dimmer circuit, which adds high frequency transitions to input signal $V_{IN}$ 112 by removing portions of the ac line voltage $V_{AC}$ 110 to limit the amount of voltage and current supplied by input signal $V_{IN}$ 112 and input current $I_{IN}$ 114, respectively, that are received by the power converter 100.

As shown in the depicted example, power converter 100 also includes bleeder circuit 104, which includes a first terminal 126 to be coupled to the first terminal 109 of the input of driver circuit 106. In one example, bleeder circuit 104 is an active bleeder circuit in accordance with the teachings of the present invention. Bleeder circuit 104 also includes a second terminal 128 to be coupled to the second terminal 111 of the input of driver circuit 106. In various examples, bleeder circuit 104 may be implemented as a monolithic integrated circuit or may be implemented with discrete electrical components or a combination of discrete and integrated components in accordance with the teachings of the present invention.

In one example, bleeder circuit 104 includes a current sense circuit 119, which is coupled between first and second terminals 109 and 111 of the input of driver circuit 106. In one example, current sense circuit 119 is coupled to output a current sense signal 123 in response to input current $I_{IN}$ 114 through the input 105 of the power converter 100 coupled to the input of the of driver circuit 106. In one example, current sense signal 123 is coupled to indicate if the input current $I_{IN}$ 114 has fallen to less than threshold current $I_{TH}$. As shown, current sense signal 114 is coupled to be received by a variable current circuit 122. In one example, an edge detection circuit 120 is also coupled between first and second terminals 109 and 111 of the input of driver circuit 106. In one example, edge detection circuit 120 is coupled to output an edge detection signal 124 in response to a high frequency transition sensed in input signal $V_{IN}$ 112.

As shown in the illustrated example, a variable current circuit 122 is also coupled between first and second terminals 109 and 111 of the input of driver circuit 106. As shown, variable current circuit 122 is coupled to receive current sense signal 123 from current sense circuit 119 and edge detection signal 124 from edge detection circuit 120. Variable current circuit 122 is coupled to conduct a bleeder current $I_B$ 115 between first and second terminals 109 and 111 of the input driver circuit 106 in response to current sense signal 123 in accordance with the teachings of the present invention. In addition, variable current circuit 122 is further coupled to conduct the bleeder current $I_B$ 115 between first and second terminals 109 and 111 of the input driver circuit 106 in response to edge detection signal 124 in accordance with the teachings of the present invention. With bleeder current $I_B$ 115, a sufficient holding current is drawn by input current $I_{IN}$ 114 to prevent a switch in dimmer circuit 102 from opening prematurely, which helps to prevent unwanted flickering in an LED lamp driven by driver circuit 106 in accordance with the teachings of the present invention.

Figure 2A:
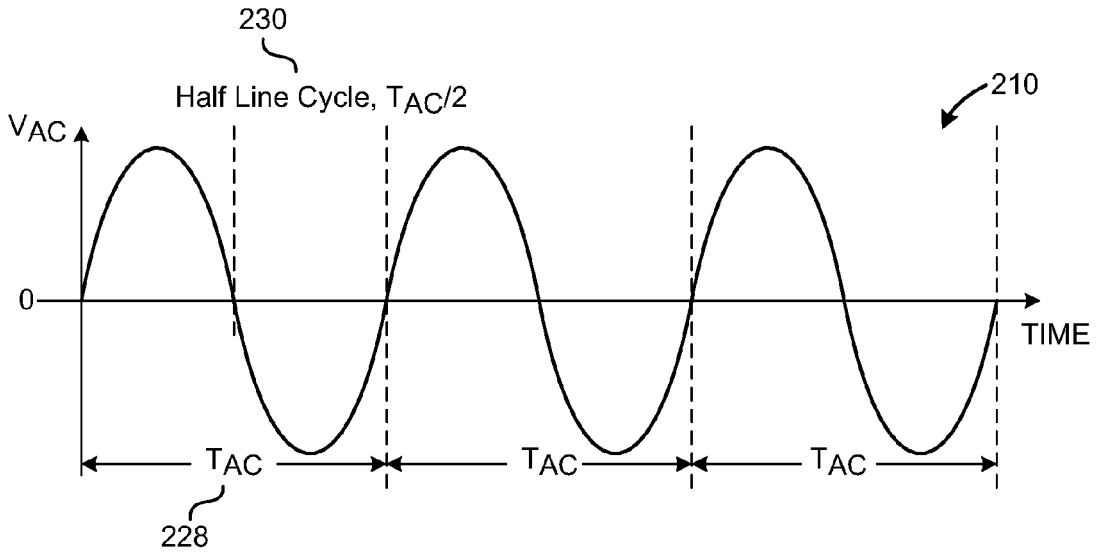
FIG. 2A illustrates an example of an ac input voltage waveform received by an example power converter of a lighting system in accordance with the teachings of the present invention.
Figure 2B:
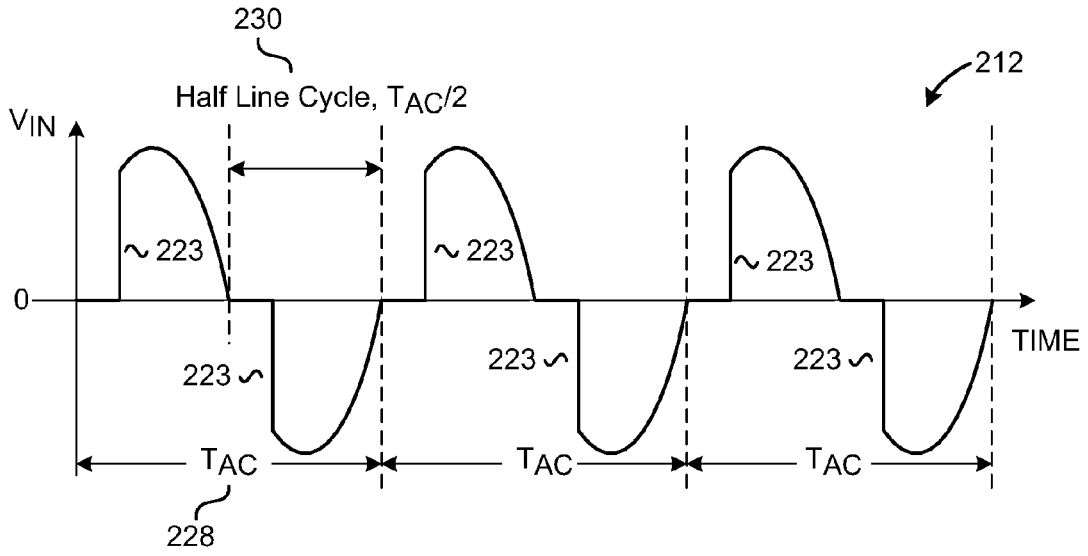
FIG. 2B illustrates an example input signal waveform received by an example power converter of a lighting system through a dimmer circuit in accordance with the teachings of the present invention.

Referring now to FIGS. 2A and 2B, FIG. 2A illustrates an example of an ac line voltage $V_{AC}$ 210 waveform received by a dimmer circuit, which is coupled to provide an input signal $V_{IN}$ 212 to an example power converter of a lighting system in accordance with the teachings of the present invention. FIG. 2B illustrates an example of an input signal $V_{IN}$ 212 waveform received by an example power converter of a lighting system from a dimmer circuit, such as for example a TRIAC dimmer circuit, in accordance with the teachings of the present invention. As shown in the depicted example, ac line voltage $V_{AC}$ 210 is an ac input voltage and therefore a sinusoidal waveform with a line cycle period 228. The line cycle period 228 of the ac line voltage $V_{AC}$ 210 may also be referred to as a full line cycle period. FIG. 2A also shows a half line cycle 230, which is half of line cycle period 228. As shown in the depicted example, half line cycle 230 is the length of time between zero crossings of ac line voltage $V_{AC}$ 210.

Referring briefly now back to FIG. 1, dimmer circuit 102 disconnects and reconnects the ac line voltage $V_{AC}$ 110 from the first terminal 109 of the input of driver circuit 106. In leading edge dimming, when the ac line voltage $V_{AC}$ 110 crosses zero voltage, dimmer circuit 102 disconnects the ac line voltage $V_{AC}$ 110 from first terminal 109. As such the ac line voltage $V_{AC}$ 110 is disconnected from the driver circuit 106 and bleeder circuit 104. After a given amount of time, dimmer circuit 102 reconnects ac line voltage $V_{AC}$ 110 to first terminal 109 of the input of driver circuit 106 and to bleeder circuit 104. It should be appreciated that embodiments may be utilized with trailing edge dimming. For trailing edge dimming, the dimmer circuit 102 connects the ac line voltage $V_{AC}$ 110 from the first terminal 109 when the ac line voltage $V_{AC}$ 110 crosses zero voltage and disconnects the ac line voltage $V_{AC}$ 110 after a given amount of time. Referring now to FIGS. 1 and 2B, the dimmer circuit 102 removes a portion of each half line cycle 230 of ac line voltage $V_{AC}$ 210 to provide the voltage waveform shown as input signal $V_{IN}$ 212, thus limiting the amount of voltage and current supplied to load 108 by driver circuit 106. As shown in FIG. 2B, the voltage of input signal $V_{IN}$ 212 is substantially zero when the dimmer circuit 102 has disconnected the ac line voltage $V_{AC}$ 210 from first input 109. The voltage waveform of input signal $V_{IN}$ 212 substantially follows the ac line voltage $V_{AC}$ 210 when the dimmer circuit 102 reconnects the ac line voltage $V_{AC}$ 210 to first input 109. FIG. 2B illustrates the edges 223 in input signal $V_{IN}$ 212 during each half line cycle 230 resulting from the high frequency transitions 223 caused by dimmer circuit 102 disconnecting and reconnecting ac line voltage $V_{AC}$ 210 as discussed.

The amount of desired dimming corresponds to the length of time during which the dimmer circuit 102 disconnects the ac line voltage $V_{AC}$ 210 from first terminal 109 of the input of driver circuit 106. It is noted that dimmer circuit 102 also includes an input (not shown), which provides dimmer circuit 102 with information regarding the amount of desired dimming. The longer dimmer circuit 102 disconnects the ac line voltage $V_{AC}$ 210 from the power converter, the longer the voltage of input signal $V_{IN}$ 212 is substantially equal to zero voltage.

Figure 3A:
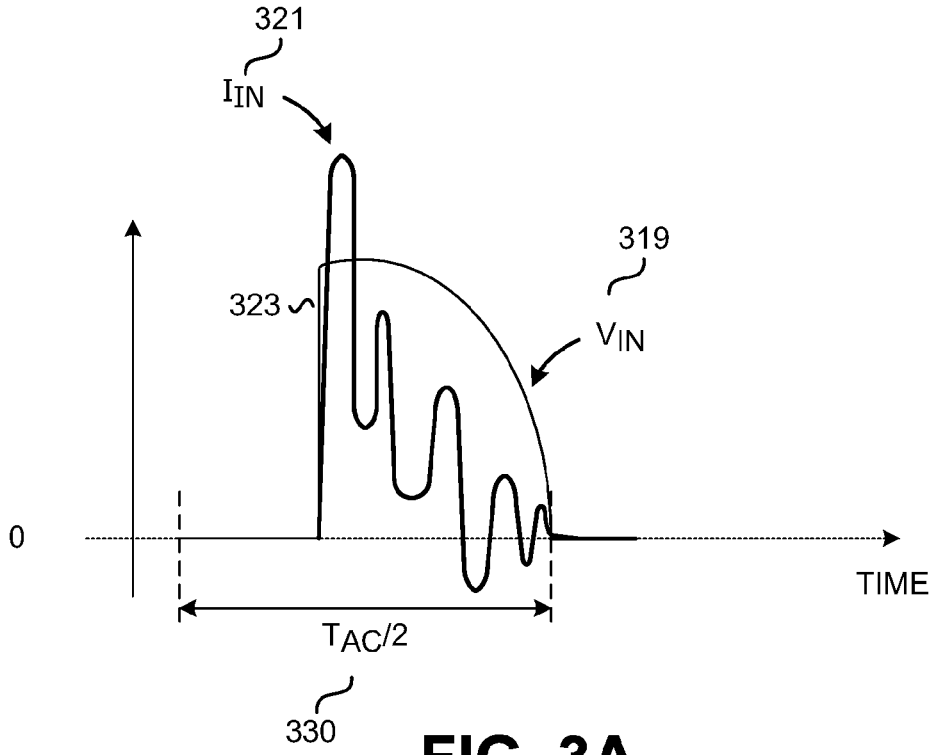
FIG. 3A illustrates example voltage and current waveforms of an input signal of a power converter of a lighting system.
Figure 3B:
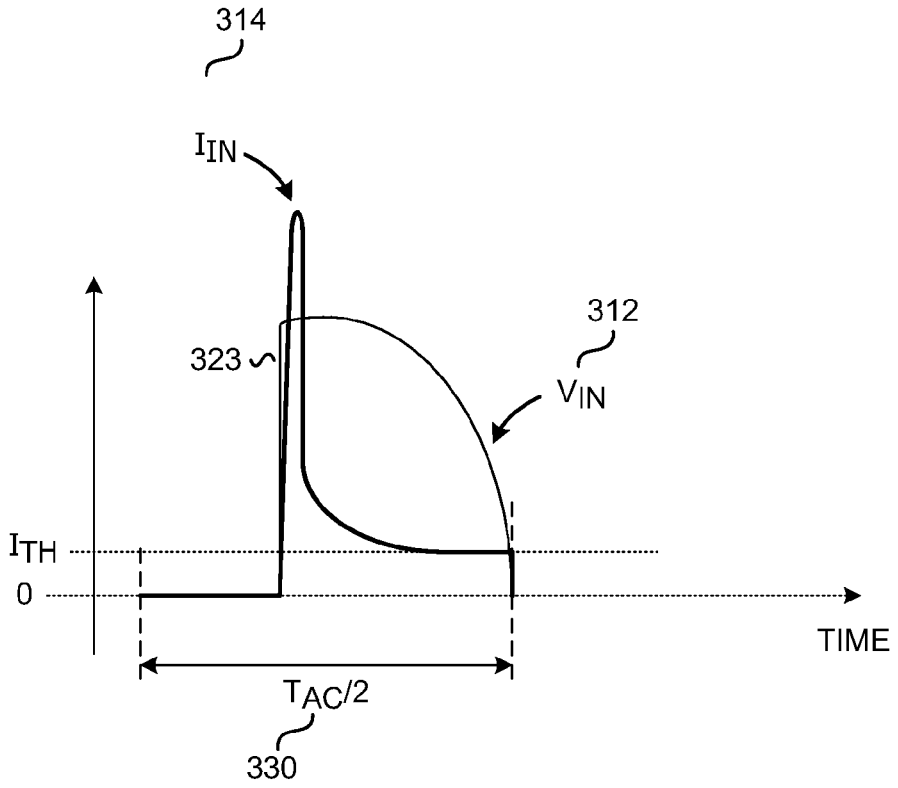
FIG. 3B illustrates example voltage and current waveforms of an input signal received by a power converter of a lighting system in accordance with the teachings of the present invention.

Referring next to FIGS. 3A and 3B, FIG. 3A illustrates example input signal $V_{IN}$ 319 waveform and input current $I_{IN}$ 321 waveform of an input signal of a power converter of a lighting system. FIG. 3B illustrates an example input signal $V_{IN}$ 312 waveform and input current $I_{IN}$ 314 waveform received by a power converter of a lighting system in accordance with the teachings of the present invention. In particular, FIG. 3A shows an example input signal $V_{IN}$ 319 waveform and input current $I_{IN}$ 321 waveform for one half line cycle 330 as output by a dimmer circuit, such as for example dimmer circuit 102. In the example depicted in FIG. 3A, input signal $V_{IN}$ 319 waveform and input current $I_{IN}$ 321 waveform are received by the input of the power converter 100 of the lighting system, which are received by driver circuit 106 when bleeder circuit 104 is not included in power converter 100. FIG. 3B illustrates an example of input signal $V_{IN}$ 312 waveform and input current $I_{IN}$ 314 waveform of power converter 100 when bleeder circuit 104 is included in power converter 100 in accordance with the teachings of the present invention.

As discussed above, the voltage of input signal $V_{IN}$ 319 shown in FIG. 3A is substantially zero at the beginning of half line cycle 330. When the dimmer circuit 102 reconnects the ac line voltage $V_{AC}$ 110, the voltage of input signal $V_{IN}$ 319 increases quickly at high frequency transition 323 and substantially follows the voltage of ac line voltage $V_{AC}$ 110 for the remainder of the half line cycle 330. At the beginning of the half line cycle 330, the input current $I_{IN}$ 321 is also substantially zero until the dimmer circuit 102 fires. Once the dimmer circuit 102 fires, the input current $I_{IN}$ 321 also increases quickly such that there is also a high frequency transition 323 of input current $I_{IN}$ 321. As shown in FIG. 3A, without the inclusion of bleeder circuit 104, the input current $I_{IN}$ 321 rings. This is partially due to an input capacitor included within the driver circuit 106 and other inductive and capacitive elements included within driver circuit 106. As illustrated in FIG. 3A, the input current $I_{IN}$ 321 may reverse polarity several times during the half line cycle 330 as a consequence of the ringing. If the input current $I_{IN}$ 321 has fallen below the holding current of the dimmer circuit 102 before the end of the half line cycle 330, or before the input signal $V_{IN}$ 319 has reached zero, the dimmer circuit 102 may prematurely turn off and cause flickering in the load 108 driven by driver circuit 106.

However, examples in accordance with teachings of the present invention may reduce the ringing of the dimmer current, as shown by input current $I_{IN}$ 314 in FIG. 3B. Similar to the discussion above in connection with FIG. 2B, the voltage of input signal $V_{IN}$ 312 is substantially zero until the dimmer circuit 102 fires and the voltage of input signal $V_{IN}$ 312 increases at high frequency transition 323 and substantially follows the voltage of ac line voltage $V_{AC}$ 110. The input current $I_{IN}$ 314 is also substantially zero until the dimmer circuit 102 reconnects the ac line voltage $V_{AC}$ 110. Once the dimmer circuit 102 reconnects the ac line voltage $V_{AC}$ 110, the input current $I_{IN}$ 314 also increases quickly at high frequency transition 323. However, as shown in FIG. 3B, the inclusion of bleeder circuit 104 reduces the ringing and helps to prevent the input current $I_{IN}$ 314 from falling below a threshold current $I_{TH}$, which in the illustrated example maintains the input current $I_{IN}$ 314 from falling below the holding current of dimmer circuit 102 in accordance with the teachings of the present invention.

Therefore, referring briefly back to the example depicted in FIG. 1, the inclusion of bleeder circuit 104 provides bleeder current $I_B$ 115 in response to a high frequency transition in the input signal $V_{IN}$ 112 and/or a high frequency transition in input current $I_{IN}$ 114 and/or input current $I_{IN}$ 114 falling below a threshold current $I_{TH}$, which help to prevent the input current $I_{IN}$ 114 from falling below the holding current of dimmer circuit 102 in accordance with the teachings of the present invention. As will be further discussed, the peak value of input current $I_{IN}$ 114 and the length of time which the input current $I_{IN}$ 114 decays may be partially determined by the characteristic of the bleeder circuit 104 in accordance with the teachings of the present invention.

Figure 4A:
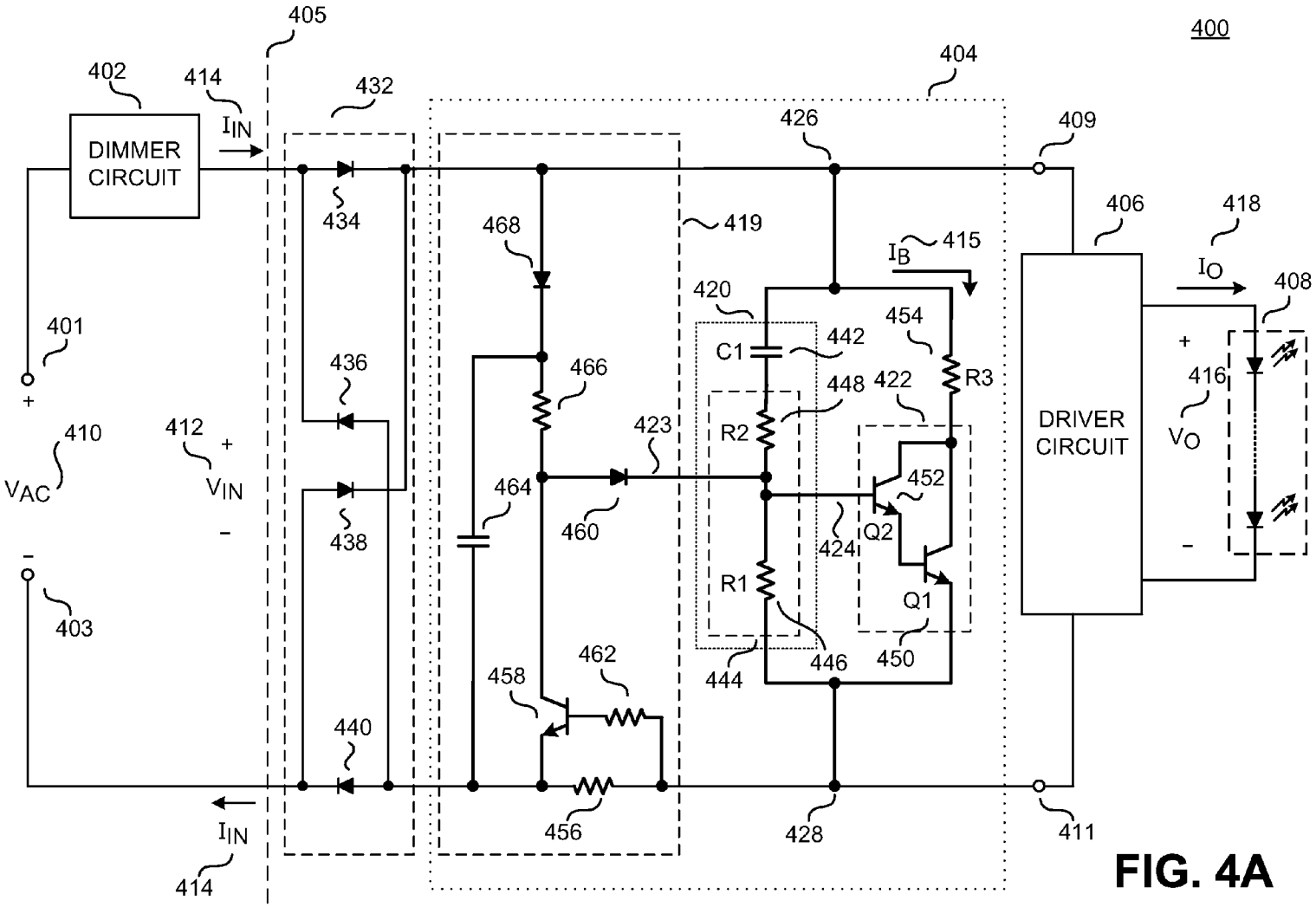
FIG. 4A is a schematic of an example of a power converter included in a lighting system including one example bleeder circuit in accordance with the teachings of the present invention.

FIG. 4A is a schematic illustrating an example of a power converter 400 included in a lighting system including an example bleeder circuit 404 in accordance with the teachings of the present invention. As shown, power converter 400 includes a driver circuit 406 that is coupled to drive a load 408 with an output voltage $V_O$ 416 and an output current $I_O$ 418. In one example, driver circuit 406 includes a switched mode power converter and load 408 includes one or more light emitting diode (LED) lamps. Driver circuit 406 includes an input having a first terminal 409 and a second terminal 411, which are coupled to an input 405 of power converter 400 coupled to receive an input signal $V_{IN}$ 412 and an input current $I_{IN}$ 414. In one example, input signal $V_{IN}$ 412 is to be received from a dimmer circuit 402, which is coupled to receive an ac line voltage $V_{AC}$ 410 between terminals 401 and 403. Dimmer circuit 402 may be external to power converter 400. In one example, dimmer circuit 402 includes a TRIAC dimmer circuit, which removes portions of the ac line voltage $V_{AC}$ 410 to limit the amount of voltage and current supplied in input voltage $V_{IN}$ 412 and input current $I_{IN}$ 414, respectively, that are received by power converter 400. In another example, dimmer circuit 402 includes a thyristor dimmer circuit, which removes portions of the ac line voltage $V_{AC}$ 410 to limit the amount of voltage and current supplied in input voltage $V_{IN}$ 412 and input current $I_{IN}$ 414, respectively, that are received by power converter 400. In the depicted example, a rectifier 432 is also included and is coupled to the input 405 of the power converter 400. In one example, rectifier 432 includes diode 434, diode 436, diode 438 and diode 440 coupled as shown to provide full wave rectification of input signal $V_{IN}$ 412.

As shown in the depicted example, power converter 400 also includes bleeder circuit 404, which includes a first terminal 426 coupled to first terminal 409 of the input of driver circuit 406. In one example, bleeder circuit 404 is an active bleeder circuit in accordance with the teachings of the present invention. Bleeder circuit 404 also includes a second terminal 428 coupled to second terminal 411 of the input of driver circuit 406. Bleeder circuit 404 may be implemented as a monolithic integrated circuit or may be implemented with discrete electrical components or a combination of discrete and integrated components.

A current sense circuit 419 is included in one example of bleeder circuit 404 and is coupled between first and second terminals 409 and 411 of the input of driver circuit 406. In one example, current sense circuit 419 is coupled to output a current sense signal 423 in response the input current $I_{IN}$ 414 through the input 405 of the power converter 400 coupled to the input of the driver circuit 406 falling below a threshold current $I_{TH}$.

An edge detection circuit 420 is included in one example of bleeder circuit 404 and is coupled between first and second terminals 409 and 411 of the input of driver circuit 406. In one example, edge detection circuit 420 is coupled to output an edge detection signal 424 in response to a high frequency transition sensed in input signal $V_{IN}$ 412 between first and second terminals 409 and 411 of the input of driver circuit 406.

As shown in the illustrated example, variable current circuit 422 is included in one example of bleeder circuit 404 and is coupled between first and second terminals 409 and 411 of the input of driver circuit 406. In one example, variable current circuit 422 is coupled to conduct a bleeder current $I_B$ 415 between the first and second terminals 409 ad 411 of the input of the driver circuit 406 in response to current sense signal 423 in accordance with the teachings of the present invention. In addition, the variable current circuit 422 is further coupled to conduct the bleeder current $I_B$ 415 between the first and second terminals 409 and 411 of the input of the driver circuit 406 in response to the edge detection signal 424 in accordance with the teachings of the present invention. With bleeder current $I_B$ 415, a sufficient holding current is drawn by input current $I_{IN}$ 414 to prevent a switch in dimmer circuit 402 from turning off prematurely, which prevents unwanted flickering in an LED lamp driven by driver circuit 406 in accordance with the teachings of the present invention.

As depicted in the illustrated example, current sense circuit 419 includes a current sense resistance 456 that is coupled to input terminal 411 of the input of driver circuit 406 to sense the current drawn by the power converter 400. In particular, in one example, a voltage drop across the current sense resistance 456 is responsive to the input current $I_{IN}$ 414 drawn by the power converter 400. In the example, a current sense transistor 458 is coupled to current sense resistance 456 with current sense resistance 456 being coupled to input terminal 411 and to a control terminal of current sense transistor 458 as shown. In one example, current sense resistance 456 is coupled to the control terminal of current sense transistor 458 through a resistance 462 as shown. In the example, an anode of an output diode 460 is coupled to a collector terminal of current sense transistor 458 as shown to output a current sense signal 423. In the example depicted in FIG. 4A, a capacitance 464, a diode 468 and a resistance 466 are also coupled to output diode 460 and current sense transistor 458 as shown.

In the illustrated example, current sense transistor 458 is an NPN bipolar transistor with current sense resistance 456 coupled between the base and emitter of current sense transistor 458 as shown. If one assumes that the resistance of current sense resistance 456 is equal to $R_{SENSE}$ and that the magnitude of the voltage between the base and emitter terminals of current sense transistor 458 is equal to $V_{BE}$, then at least a threshold current $I_{TH}$ equal to $V_{BE}/R_{SENSE}$ is maintained through current sense resistance 456 by regulating the collector voltage of current sense transistor 458.

For instance, if the input current $I_{IN}$ 414 drawn by driver circuit 406 is less than the threshold current $I_{TH}$, which results in the voltage drop across current sense resistance 456 being less than the turn on voltage of current sense transistor 458. In other words, the control terminal of current sense transistor 458 is pulled low. As illustrated in the example of FIG. 4A, current sense transistor 458 is an NPN bipolar transistor in the example. Therefore, if the control terminal of current sense transistor 458 is pulled low, current sense transistor 458 is therefore turned off if the input current $I_{IN}$ 414 drawn by driver circuit 406 is less than the threshold current $I_{TH}$. If the current sense transistor 458 is turned off, then the collector terminal of current sense transistor 458 is therefore pulled high, resulting in the anode of output diode 460 being pulled high and output diode 460 becoming forward biased. When output diode 460 becomes forward biased, the current sense circuit 419 provides the current sense signal 423 from output diode 460 through diode 468 and resistance 466 as shown. As will be discussed in more detail below, when the output diode is forward biased and the current sense circuit 419 provides the current sense signal 423, variable current circuit 422 draws additional current $I_B$ 415, which in one example maintains the input current $I_{IN}$ 414 above the holding current of dimmer circuit 402 in accordance with the teachings of the present invention.

If, however, the input current $I_{IN}$ 414 drawn by driver circuit 406 is greater than or equal to the threshold current $I_{TH}$, the voltage drop across current sense resistance 456 is greater than or equal to the turn on voltage of current sense transistor 458, which turns on current sense transistor 458. If current sense transistor 458 is turned on, the collector terminal of current sense transistor 458 is pulled low, resulting in the anode of output diode 460 being pulled low and output diode 460 being reverse biased. When output diode 460 is reverse biased, current sense signal 423 output from output diode 460 and received by variable current circuit 422 is substantially equal to zero. Further, output diode 460 may be utilized to ensure current flows in one direction (from current sense circuit 419 to the variable current source 422).

As shown in the illustrated example, edge detection circuit 420 includes a high pass filter coupled between the first and second terminals 426 and 428 of the bleeder circuit 404. The high pass filter 420 includes an output coupled to generate the edge detection signal 424 in response to a high frequency transition in the input signal $V_{IN}$ 412 between the first and second terminals 409 and 411 of the input of driver circuit 406. In the example depicted in FIG. 4A, the edge detection circuit 420 includes a capacitance 442 and a resistance 444 coupled between the first and second terminals 409 and 411 of the input of driver circuit 406. Therefore, in one example, high pass filter 420 is an RC filter having characteristics determined by the capacitance of capacitance 442 and the resistance of resistance 444. In the depicted example, the edge detection signal 424 is output from the resistance 444. In one example, the resistance 444 includes a resistor divider having a first resistance R1 446 and a second resistance R2 448 coupled between the capacitance 442 and the second terminal 411 of the input of driver circuit 406. In the example, the edge detection signal 424 is output from a node between the first resistance R1 446 and the second resistance R2 448.

In one example, variable current circuit 422 includes a current amplifier circuit having an input coupled to receive the current sense signal 423 and the edge detection signal 424 to conduct bleeder current $I_B$ 415 between first terminal 409 and second terminal 411 of the input of driver circuit 406 in accordance with the teachings of the present invention. In one example, a third resistance R3 454 is included and is coupled to the variable current circuit 422 and coupled between the first and second terminals 426 and 428 of the bleeder circuit 404 as shown. In the example illustrated in FIG. 4A, third resistance R3 454 is coupled between first terminal 409 of the input of driver circuit 406 and variable current circuit 422.

In one example, variable current circuit 422 includes a first transistor Q1 450 having a first terminal coupled to the first terminal 409 of the input of driver circuit 406, a second terminal coupled to the second terminal 411 of the input of driver circuit 406, and a control terminal coupled to be responsive to the current sense signal 423 and/or edge detection signal 424. In one example, variable current circuit 422 also includes a second transistor Q2 452 having a first terminal coupled to the first terminal of the first transistor Q1 450, a second terminal coupled to the control terminal of the first transistor Q1 450, and a control terminal coupled to receive the current sense signal 423 and edge detection signal 424. As shown in the example depicted in FIG. 4A, the first and second transistors Q1 450 and Q2 452 are bipolar transistors, which provide a Darlington pair coupled between the first and second terminals 409 and 411 of the input of driver circuit 406 and coupled to be responsive to current sense signal 423 and/or edge detection signal 424. It is appreciated that although FIG. 4A illustrates that first and second transistors Q1 450 and Q2 452 are NPN bipolar transistors, PNP transistors may also be utilized. It should also be appreciated that other transistors may be utilized, such as metal-oxide-semiconductor field-effect transistors (MOSFETs), junction gate field-effect transistors (JFETs), or insulated gate bipolar transistors (IGBTs).

In one example, first and second transistors Q1 450 and Q2 452 can be operated in either the active or saturation region. In an example in which first and second transistors Q1 450 and Q2 452 are operated in the active region, the third resistance R3 454 is optional. Therefore, in one example in which edge detection signal 424 is a current and in which variable current circuit 422 includes the Darlington pair of first and second transistors Q1 450 and Q2 452 operating in the active region, the bleeder current $I_B$ 415 is an amplified representation of the current of edge detection signal 424. The bleeder current $I_B$ 415 is substantially equal to the current provided by current sense signal 423 and/or the edge detection signal 424 multiplied by both the beta of first transistor Q1 450 and the beta of second transistor Q2 452 in accordance with the teachings of the present invention. Partially due to the variable current circuit 422, a smaller capacitance may be utilized for C1 442. A smaller capacitance may translate to savings in both cost and area of the power converter over previous solutions.

In another example in which first and second transistors Q1 450 and Q2 452 are operated in the saturation region, third resistance R3 454 is included, and the magnitude of bleeder current $I_B$ 415 is determined in response to the resistance value of third resistance R3 454. Therefore, in the example depicted in FIG. 4A in which first and second transistors Q1 450 and Q2 452 are operated in the saturation region, the variable current circuit 422 functions as a switch with the magnitude of bleeder current $I_B$ 415 is determined by the resistance value of third resistance R3 454.

Referring briefly back to FIG. 3B, the values selected for the capacitance C1 442 and resistance 444 may partially determine the peak value of input current $I_{IN}$ 314 and the length of time which the input current $I_{IN}$ 314 decays. In particular the equivalent impedance of capacitance C1 442 and R2 448 may determine the peak value of the input current $I_{IN}$ 314 while the time constant set by capacitance C1 442 and resistance 444 may determine the length of time input current $I_{IN}$ 314 decays to zero. Further, the values selected for capacitance C1 442 and resistance 444 may determine at what frequency the edge detector 420 responds.

Figure 4B:
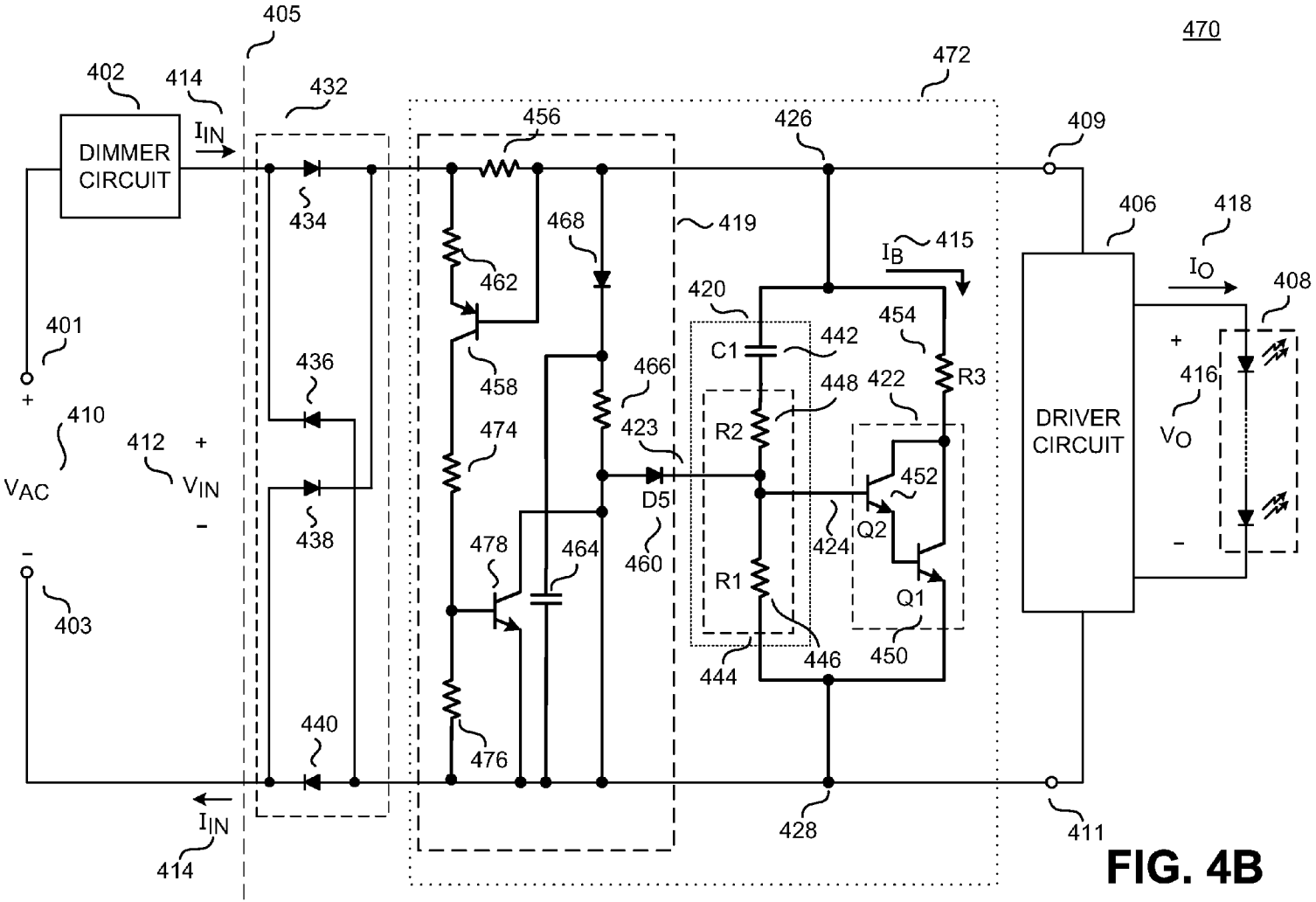
FIG. 4B is a schematic of an example of a power converter included in a lighting system including another example bleeder circuit in accordance with the teachings of the present invention.

FIG. 4B is a schematic of another example of a power converter 470 included in a lighting system including an example bleeder circuit 472 in accordance with the teachings of the present invention. It appreciated that example bleeder circuit 472 of power converter 470 as illustrated in FIG. 4B shares many similarities with example bleeder circuit 404 of power converter 400 illustrated in FIG. 4A. Indeed, it is appreciated that the operation of edge detection circuit 420 and variable current circuit 422 of FIG. 4B are substantially similar to the operation of edge detection circuit 420 and variable current circuit 422 of FIG. 4A.

One difference between example bleeder circuit 472 of FIG. 4B and example bleeder circuit 404 of FIG. 4A is that in the example depicted FIG. 4A, the current sense resistance 456 is coupled to the "low side" second terminal 411 of the input of driver circuit 406 to sense input current $I_{IN}$ 414 through the input 405 of the power converter 400 at the low side second terminal 411 of the input of driver circuit 406. However, in the example depicted in FIG. 4B, current sense resistance 456 is coupled to the "high side" first terminal 409 of the input of driver circuit 406 to sense input current $I_{IN}$ 414 through the input 405 of the power converter 400 at the high side first terminal 409 of the input of driver circuit 406. Accordingly, example current sense transistor 458 in FIG. 4B is a PNP bipolar transistor coupled to the high side first terminal 409 of the input of driver circuit 406. In particular, as shown in the depicted example, current sense transistor 458 is coupled to current sense resistance 456 with current sense resistance 456 being coupled to input terminal 409 and to a control terminal of current sense transistor 458 as shown. In one example, current sense resistance 456 is coupled to the emitter terminal of current sense transistor 458 through a resistance 462 as shown.

In the example depicted in FIG. 4B, a control terminal of a second current sense transistor 478 is coupled to the collector terminal of current sense transistor 458 through a resistance 474 as shown. The control terminal of the second current sense transistor 478 is also coupled to the second terminal 411 of the input of driver circuit 406 as shown. Further, the emitter terminal of the current sense transistor 478 is coupled to the second terminal 411. In the example, an anode of output diode 460 is coupled to the collector terminal of the second current sense transistor 478 as shown to output a current sense signal 423. In the example depicted in FIG. 4B, capacitance 464, diode 468 and resistance 466 are also coupled to output diode 460 and second current sense transistor 478 as shown.

Similar to the operation of the example bleeder circuit 404 of FIG. 4A, if one assumes that the resistance of current sense resistance 456 is equal to $R_{SENSE}$ and that the magnitude of the voltage between the emitter and base terminals of current sense transistor 458 is equal to $V_{EB}$, then at least a threshold current $I_{TH}$ equal to $V_{EB}/R_{SENSE}$ is maintained through current sense resistance 456 by regulating the collector voltage of current sense transistor 458, which regulates the collector voltage of second current sense transistor 478.

For instance, if the input current $I_{IN}$ 414 drawn by power converter 400 is less than the threshold current $I_{TH}$, which results in the voltage drop across current sense resistance 456 being less than the turn on voltage of current sense transistor 458. In other words, the control terminal of current sense transistor is pulled high. As illustrated in the example of FIG. 4B, current sense transistor 458 is a PNP bipolar transistor in the example. Therefore, if the control terminal of current sense transistor 458 is pulled high, current sense transistor 458 is therefore turned off if the input current $I_{IN}$ 414 drawn by power converter is less than the threshold current $I_{TH}$. If the current sense transistor 458 is turned off, then the control terminal of second current sense transistor 478 is no longer pulled high through current sense transistor 458. As illustrated in the example of FIG. 4B, second current sense transistor 478 is an NPN bipolar transistor. If the control terminal of second current sense transistor 478 is not pulled high through current sense transistor 458, second current sense transistor 478 also turns off. When the second current sense transistor 478 is turned off, the collector terminal of the second current sense transistor 478 is pulled high, resulting in the output diode 460 becoming forward biased. When output diode 460 becomes forward biased, the current sense circuit 419 provides the current sense signal 423 from output diode 460 through diode 468 and resistance 466 as shown. As discussed above, when the output diode 460 is forward biased and the current sense circuit 419 provides the current sense signal 423, variable current circuit 422 draws additional current $I_B$ 415, which in one example keeps the input current $I_{IN}$ 414 above the holding current of dimmer circuit 402 in accordance with the teachings of the present invention.

If, however, the input current $I_{IN}$ 414 drawn by driver circuit 406 is greater than or equal to the threshold current $I_{TH}$, the voltage drop across current sense resistance 456 pulls the control terminal of current sense transistor 458 low, which therefore turns on current sense transistor 458. If current sense transistor 458 is turned on, the control terminal of second current sense transistor 478 is pulled high through current sense transistor 458, which turns on second current sense transistor 478. If second current sense transistor 478 is turned on, the collector terminal of second current sense transistor 478 is pulled low, resulting in the anode of output diode 460 being pulled low and output diode 460 is reverse biased. When output diode 460 is reverse biased, the current sense circuit 419 no longer provides the current sense signal 423.

The above description of illustrated examples of the present invention, including what is described in the Abstract, are not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

What is claimed is:

1. A bleeder circuit for use in a power converter of a lighting system, comprising:

a current sense circuit coupled between first and second terminals of an input of a driver circuit to be coupled to drive a load, the current sense circuit coupled to output a current sense signal in response to an input current through an input of the power converter coupled to the input of the driver circuit;

an edge detection circuit coupled between the first and second terminals of the input of the driver circuit, the edge detection circuit coupled to output an edge detection signal in response to an input signal between the first and second terminals of the input of the driver circuit; and a variable current circuit coupled between the first and second terminals of the input of the driver circuit, the variable current circuit coupled to conduct a bleeder current between the first and second terminals of the input of the driver circuit in response to the current sense signal, the variable current circuit further coupled to conduct the bleeder current between the first and second terminals of the input of the driver circuit in response to the edge detection signal.

2. The bleeder circuit of claim 1 wherein the variable current circuit is coupled to increase the bleeder current in response to the current sense signal indicating that the input current is less than a threshold current.

3. The bleeder circuit of claim 2 wherein the threshold current is greater than or equal to holding current of a dimmer circuit coupled to the input of the power converter.

4. The bleeder circuit of claim 1 wherein the current sense circuit comprises a current sense resistance coupled to one of the first and second terminals of the input of the driver circuit, wherein a voltage drop across the current sense resistance is responsive to the input current.

5. The bleeder circuit claim 4 wherein the variable current circuit is coupled to increase the bleeder current in response to the voltage drop across the current sense resistance being less than a threshold voltage.

6. The bleeder circuit of claim 4 wherein the current sense circuit further comprises a current sense transistor coupled to the current sense resistance, wherein the current sense transistor is coupled to be turned on in response to the voltage drop across the current sense resistance.

7. The bleeder circuit of claim 6 wherein the current sense resistance is coupled to a control terminal of the current sense transistor and coupled to said one of the first and second terminals of the input of the driver circuit.

8. The bleeder circuit of claim 1 wherein the edge detection circuit comprises a high pass filter coupled between the first and second terminals of the input of the driver circuit, wherein the high pass filter is coupled to output the edge detection signal in response to a high frequency transition in the input signal between the first and second terminals of the input of the driver circuit.

9. The bleeder circuit of claim 1 wherein the edge detection circuit comprises a capacitance and a resistance coupled between the first and second terminals of the input of the driver circuit, wherein the edge detection signal is output from the resistance.

10. The bleeder circuit of claim 1 wherein the edge detection circuit comprises a capacitance and a resistance coupled between the first and second terminals of the input of the driver circuit, wherein the resistance comprises a first resistance and a second resistance coupled between the capacitance and the second terminal, wherein the edge detection signal is output from a node between the first resistance and the second resistance.

11. The bleeder circuit of claim 1 wherein the variable current circuit comprises a current amplifier circuit having an input coupled to receive the current sense signal and coupled to receive the edge detection signal, wherein the current amplifier circuit is coupled between the first and second terminals of the input of the driver circuit to conduct the bleeder current in response to the current sense signal and further in response to the edge detection signal.

12. The bleeder circuit of claim 1 wherein the variable current circuit comprises a first transistor having a first terminal coupled to one of the first and second terminals of the input of the driver circuit, the first transistor having a second terminal coupled to an other one of the first and second terminals of the input of the driver circuit, the first transistor further having a control terminal coupled to be responsive to the current sense signal and further coupled to be responsive to the edge detection signal.

13. The bleeder circuit of claim 1 wherein the variable current circuit comprises:

a first transistor having a first terminal coupled to one of the first and second terminals of the input of the driver circuit, a second terminal coupled to an other one of the first and second terminals of the input of the driver circuit, and a control terminal; and a second transistor having a first terminal coupled to the first terminal of the first transistor, a second terminal coupled to the control terminal of the first transistor, and a control terminal coupled to receive the current sense signal from the current sense circuit, and further coupled to receive the edge detection signal from the edge detection circuit.

14. The bleeder circuit of claim 13 wherein the first and second transistors are bipolar transistors, and wherein the first and second transistors are included in a Darlington pair coupled between the first and second terminals of the input of the driver circuit, and coupled to be responsive to the current sense signal and further coupled to be responsive to the edge detection signal.

15. The bleeder circuit of claim 1 further comprising a third resistance coupled to the variable current circuit and coupled between the first and second terminals of the input of the driver circuit.

16. The bleeder circuit of claim 1 wherein the input signal comprises an input voltage coupled to be received by the first and second terminals of the input of the driver circuit from a dimmer circuit.

17. A power converter for use in a lighting system, comprising:

a driver circuit coupled having an input coupled to receive an input signal to drive a load coupled to an output of the driver circuit; and a bleeder circuit coupled between first and second terminals of the input of the driver circuit, the bleeder circuit comprising:

a current sense circuit coupled between first and second terminals of the input of the driver circuit, the current sense circuit coupled to output a current sense signal in response to an input current through an input of the power converter coupled to the input of the driver circuit;

an edge detection circuit coupled between the first and second terminals of the input of the driver circuit, the edge detection circuit coupled to output an edge detection signal in response to the input signal coupled to be received by the input of the driver circuit; and a variable current circuit coupled between the first and second terminals of the input of the driver circuit, the variable current circuit coupled to conduct a bleeder current between the first and second terminals of the input of the driver circuit in response to the current sense signal, the variable current circuit further coupled to conduct the bleeder current between the first and second terminals of the input of the driver circuit in response to the edge detection signal.

18. The power converter of claim 17 further comprising a rectifier coupled to the input of the power converter.

19. The power converter of claim 17 wherein the variable current circuit is coupled to increase the bleeder current in response to the current sense signal indicating that the input current is less than a threshold current.

20. The power converter of claim 17 wherein the threshold current is greater than or equal to holding current of a thyristor circuit coupled to the input of the power converter.

21. The power converter of claim 17 wherein the current sense circuit comprises a current sense resistance coupled to one of the first and second terminals of the input of the driver circuit, wherein a voltage drop across the current sense resistance is responsive to the input current.

22. The power converter of claim 21 wherein the variable current circuit is coupled to increase the bleeder current in response to the voltage drop across the current sense resistance being less than a threshold voltage.

23. The power converter of claim 21 wherein the current sense circuit further comprises a current sense transistor coupled to the current sense resistance, wherein the current sense transistor is coupled to be turned on in response to the voltage drop across the current sense resistance.

24. The power converter of claim 23 wherein the current sense resistance is coupled between a control terminal of the current sense transistor and said one of the first and second terminals of the input of the driver circuit.

25. The power converter of claim 17 wherein the input signal comprises an input voltage received by the input of the driver circuit from a thyristor circuit coupled to add high frequency transitions to half line cycles of the input signal.

26. The power converter of claim 17 wherein the edge detection circuit comprises a high pass filter coupled between the first and second terminals of the input of the driver circuit, wherein the high pass filter is coupled to output the edge detection signal in response to a high frequency transition in the input signal between the first and second terminals of the input of the driver circuit.

27. The power converter of claim 17 wherein the edge detection circuit comprises a capacitance and a resistance coupled between the first and second terminals of the input of the driver circuit, wherein the edge detection signal is output from the resistance.

28. The power converter of claim 17 wherein the edge detection circuit comprises a capacitance and a resistance coupled between the first and second terminals of the input of the driver circuit, wherein the resistance comprises a first resistance and a second resistance coupled between the capacitance and the second terminal, wherein the edge detection signal is output from a node between the first resistance and the second resistance.

29. The power converter of claim 17 wherein the variable current circuit comprises a current amplifier circuit having an input coupled to receive the current sense signal and coupled to receive the edge detection signal, wherein the current amplifier circuit is coupled between the first and second terminals of the input of the driver circuit to conduct the bleeder current in response to the current sense signal and further in response to the edge detection signal.

30. The power converter of claim 17 wherein the variable current circuit comprises a first transistor having a first terminal coupled to one of the first and second terminals of the input of the driver circuit, the first transistor having a second terminal coupled to an other one of the first and second terminals of the input of the driver circuit, the first transistor further having a control terminal coupled to be responsive to the current sense signal and further coupled to be responsive to the edge detection signal.

31. The power converter of claim 17 wherein the variable current circuit comprises:

a first transistor having a first terminal coupled to one of the first and second terminals of the input of the driver circuit, a second terminal coupled to an other one of the first and second terminals of the input of the driver circuit, and a control terminal; and a second transistor having a first terminal coupled to the first terminal of the first transistor, a second terminal coupled to the control terminal of the first transistor, and a control terminal coupled to receive the current sense signal from the current sense circuit, and further coupled to receive the edge detection signal from the edge detection circuit.

32. The power converter of claim 31 wherein the first and second transistors are bipolar transistors, and wherein the first and second transistors are included in a Darlington pair coupled between the first and second terminals of the input of the driver circuit, and coupled to be responsive to the current sense signal and further coupled to be responsive to the edge detection signal.

33. The power converter of claim 17 wherein the load comprises a light emitting diode lamp.

* * * * *